United States Patent [19]

Balma

[11] 4,243,168

[45] Jan. 6, 1981

[54] OFFICE STAPLER DEVICE

[76] Inventor: Giorgio Balma, Viale Umberto 1°, 35, 27058 Voghera Pavia, Italy

[21] Appl. No.: 972,251

[22] Filed: Dec. 22, 1978

[30] Foreign Application Priority Data

Jan. 27, 1978 [IT] Italy ..... 19744 A/78

[51] Int. Cl.[3] ..... B25C 5/02

[52] U.S. Cl. ..... 227/119; 227/109; 227/123

[58] Field of Search ..... 227/109, 107, 119, 120, 227/123

[56] References Cited

U.S. PATENT DOCUMENTS 2,667,638 2/1954 Segal ..... 227/120

4,040,556 8/1977 Dahle ..... 227/120

FOREIGN PATENT DOCUMENTS 647179 12/1950 United Kingdom ..... 227/123

967415 8/1964 United Kingdom ..... 227/120

*Primary Examiner*—Paul A. Bell

*Attorney, Agent, or Firm*—Bucknam and Archer

[57] ABSTRACT

A stapler device having a staple sliding guide member that is slightly retractable to prevent jamming of staples in the staple exit passage, and a counter-guide member which is held raised when the stapler device is in a non-operate condition and is lowered against the staples, thereby contributing to the aligning thereof, when the stapler device is operated.

1 Claim, 8 Drawing Figures

OFFICE STAPLER DEVICE

The present invention relates to an improved office stapler device.

As it is known, exist in the commerce several types of office stapler devices.

The main part of the known stapler devices are however affected, in the use, by a plurality of drawbacks of functional and structural nature, which do not allow for the necessary practicity and use reliability characteristics to be obtained.

Accordingly, the main object of the present invention is to provide an improved office stapler device, in which the several component mechanical parts thereof have been modified and improved, in such a way as to eliminate any drawbacks.

The stapler device according to the present invention is characterized in that it is provided with an oscillating type of staple-supporting guide member.

This characteristic allows for an easy and unobstructed sliding of the staples, in particular in the front portion of the body of the device itself.

Therefore each staple is well positioned at the zone thereinto, due to the action of the staple driver, it will be inserted and bent for the stapling operation.

The staple sliding guide member is designed and applied in such a way as to be able of slightly retracting, thereby enlarging the cross-section of the space for the passage of the staple and staple driver thereby allowing for a staple, possibly jamming in said passage during the stapling operation, to free fall.

Furthermore the improved stapler device according to the invention is provided with a special counter-guide member, which is held rised as the stapler device is in the rest position thereof and lowers against the staples, thereby contributing to the aligning thereof, as said stapler device is operated.

Other remarkable advantages of the instant stapler device are obtained from the staple container which has a capacity greater than that of any known stapler device and which, owing to the special shape thereof, allows for even single staples to be used, i.e. those staples, which, for any reasons, are in a loose condition, in other words not associated to form a block.

In fact the instant container is formed by a sliding guide and the stapler device body containing said sliding guide.

The staples, bridged onto the guide, are caused to advance with the two ends thereof vertically oriented inserted between the outer side walls of said guide and the inner side walls of the body.

Accordingly, even in the case in which are present single staples, these latter are prevented from transversely falling into the container space or from advancing in a non right condition, as on the contrary frequently occurs in the conventional types of stapler devices.

A further improvement of the stapler device according to the present invention consists in the fact that, in said stapler device, the staple driver and the cap rising spring are formed by an integral or single piece of hardened steel, suitably shaped and applied to the inside of the cap, by suitable fixing means.

These and other characteristics, of functional and constructional nature, of the office stapler device according to the present invention will become more apparent from the following description in which it will be made reference to the accompanying drawings, illustrating a preferred but not limitative embodiment of the present invention and where:

Figure 1:
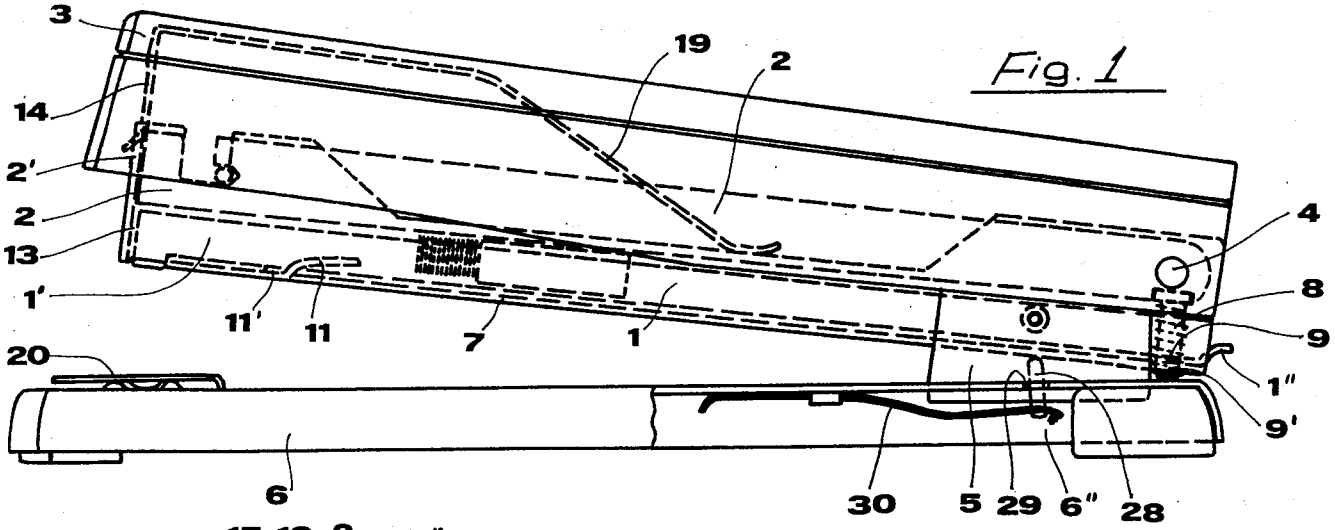
FIG. 1 illustrates a side view of the stapler device according to the present invention.

Referring particularly to the figures, the instant office improved stapler device comprises, essentially, the base (6), an intermediate U-shaped cross section body (7), supporting the metal staples, a counter guide member (2) and a cap (3).

The base (6), at the rear portion (6'') thereof, is provided with two vertical supporting elements (5) spaced from one another and parallely extending.

Each said supporting element is provided with a hole effective to act as the housing seat for the terminal ends of the horizontal pin (4), transversely oriented with respect to the longitudinal axis of the stapler device, and located at the rear portion of the intermediate body (7).

This through pin (4) allows for the intermediate body (7), effective to partially swing about said pin (4), to be connected to the two vertically extending elements (5) rigid with the rear portion (6'') of the base (6).

In correspondence to the lower surface of said intermediate U-shaped scross section body (7) acts a rod (28), vertically extending, and housed in a hole or housing seat (29), formed in the base (6) of the instant stapler device.

This rod (28) is upwardly pushed by the elastic action exerted by one end of the blade spring (30) anchored, at the other end thereof, in a slot, formed by cutting and drawing, at the lower surface of the base 6.

The aforesaid rod (8) upwardly pushes the intermediate body (7) as the operator ends his manual pressing action onto the cap (3).

The intermediate body (7) contains the sliding guide member (1) for the staples, said guide member being also of substantially U-shaped cross section.

The staple guide member (1), is captively slidable on the intermediate body (7) and this allows the staples to freely slide along such intermediate body (7).

Staples inserted against the sliding guide member (1) are properly positioned, whether the staples are separate single staples or joined together in a group or block, by reason of the U-shaped cross section of the guide member (1) and the U-shaped channel formed by inner vertical walls of the intermediate body (7).

The U-shaped cross section sliding member (1) and intermediate body (7) thus delimitate a double rail in which staples may be perfectly positioned, even if said staples are separated from the staple block or singly inserted.

The stapler device body (7), at the front portion of the horizontal surface thereof is provided with a tab (11), preferably formed by cutting and partially bending a sheet portion.

The aforesaid tab (11) engages in a suitable hollow (11') formed in the guide member (1), thereby preventing said guide member (1) from raising from the stapler device body (7).

The guide member (1) is maintained in the working position thereof by the pressure of the spring (10), wound up onto the pin (8), inserted through corresponding holes (9) and (9'), respectively formed in the sliding guide member (1) and body (7) of the stapler device.

Figure 3:
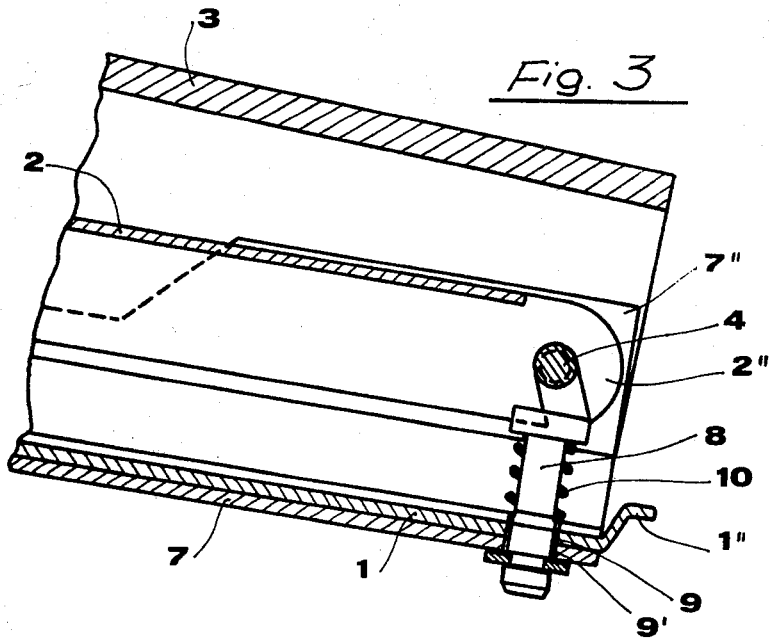
FIG. 3 illustrates the cross-section, as remarkably enlarged, of the rear end portion of the upper part of the instant stapler device.
Figure 4:
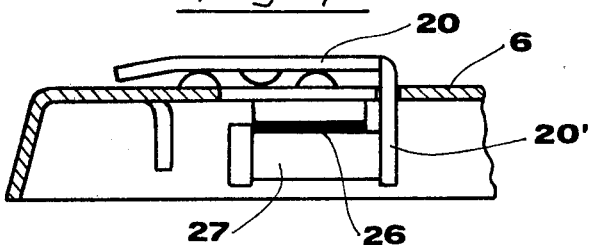
FIG. 4 and FIG. 5 illustrate, respectively, the longitudinal cross section and the cross section of the front end of the base of the instant stapler device.
Figure 5:
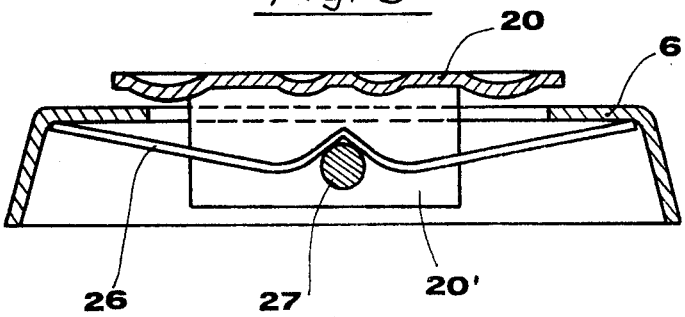
Figure 6:
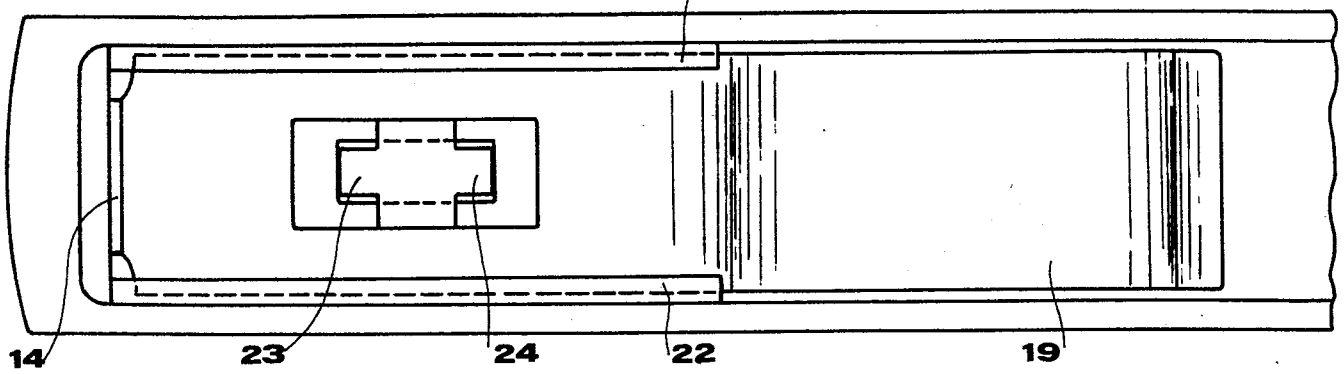
FIGS. 6 and 7 illustrate respectively a bottom view and the longitudinal cross section of the front portion of the cap of the instant stapler device.
Figure 7:
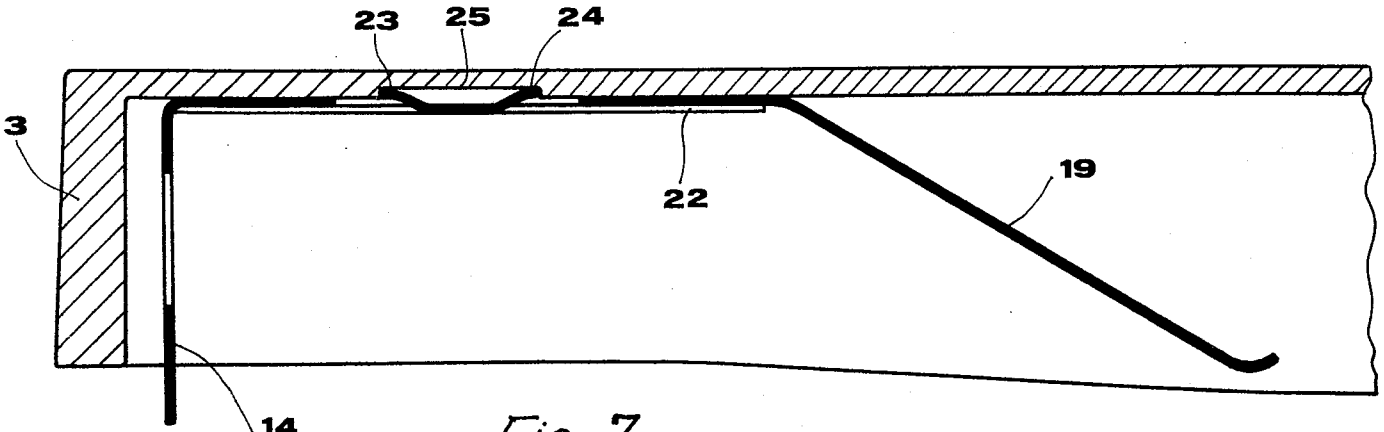

The sliding guide member (1) is provided with a projecting rear lug (1'') that serves to discharge from the stapler device such staples as possibly become jammed between the stapler driver (14) and front wall of the body (7) and/or the front portion of the guide member (1'). By upwardly moving the rear lug (1''), as can be better appreciated from FIGS. 1 and 3 taken together, the hole (9) in guide member (1) is positioned around the smaller diameter portion of the pin (8) such that the guide member (1) and the frontal portion (1') thereof shifts from its normal working position to enlarge the staple passage (13). This makes it easier for a jammed staple to be brought out by the action of the driver (14) so that the staple device can be returned to a normal operating condition.

Figure 2:
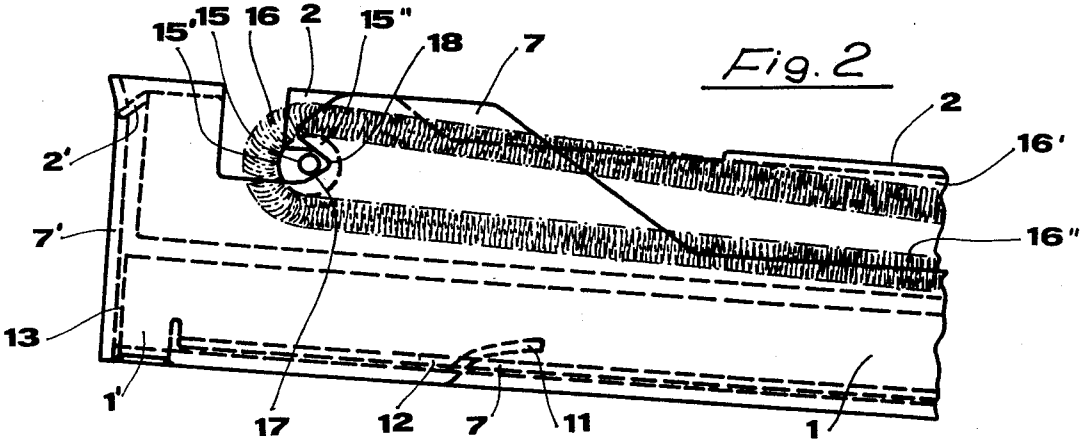
FIG. 2 illustrates a side and remarkably enlarged view of the front end portion of the stapler device shown in FIG. 1.
Figure 8:
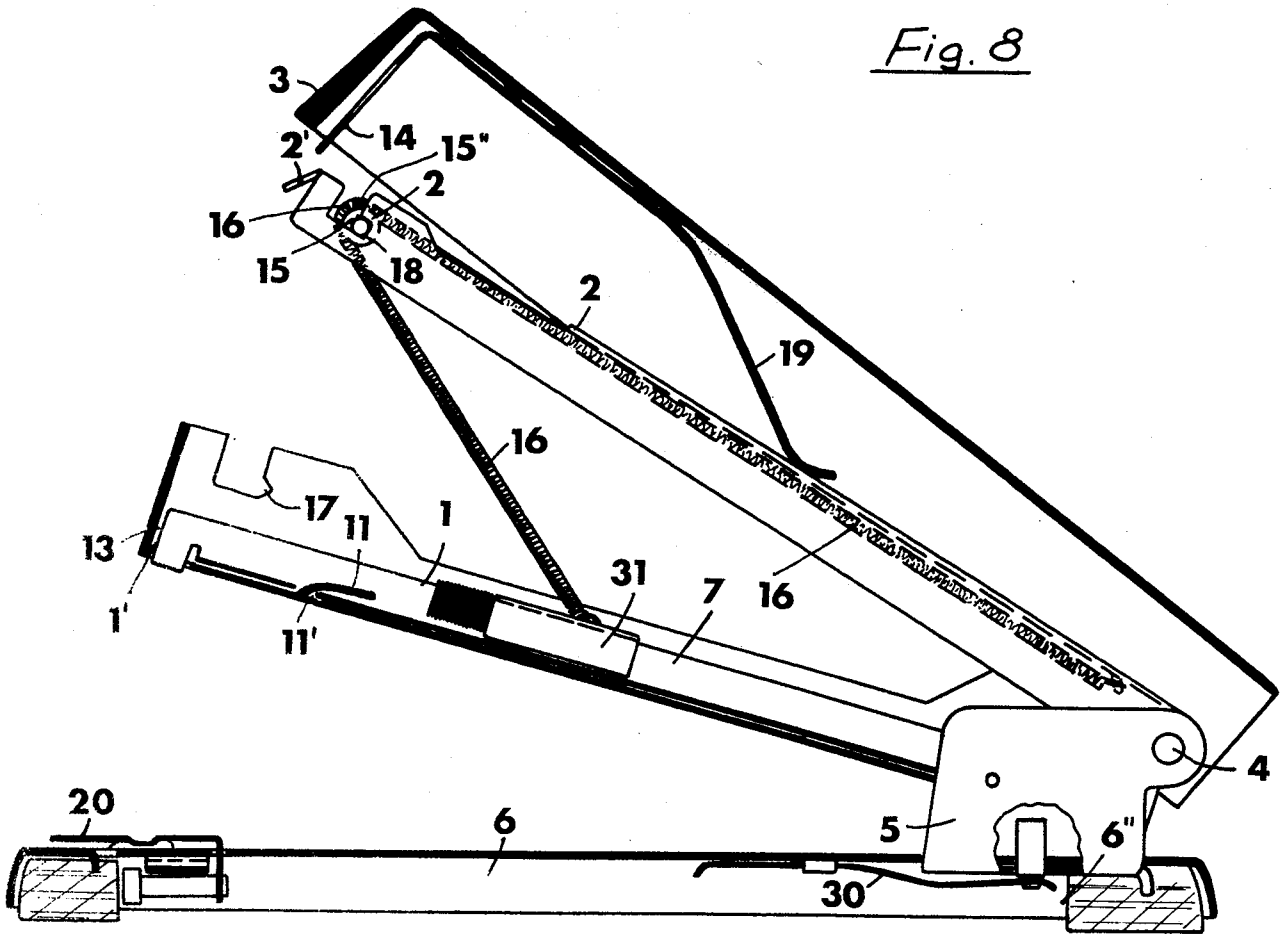
FIG. 8 illustrates a sectioned side view of the instant stapler device in the opening position thereof.

The stapler device is provided with a counter-guide member (1), as shown by FIG. 8 and by FIGS. 1 and 2 can be positioned into a separate relation to the body (7) in order to facilitate loading of staples onto the guide member (1). The counter guide (2) can be positioned into proximity with the guide member (1), as shown in FIG. (1) and secured in such position by the combined action of latching pin (15) carried on counter guide member (2) and engaging into notch (17) of the body (7).

This notch (17) has a slanted profile, thereby maintaining said pin (15) and hence the counter-guide member in a rised condition as the stapler device is in the rest position thereof.

As the stapler device is pressed down, the raising spring (19), resting onto the counter guide member (2), causes this latter to lower and, through said counter guide member (2) it causes the staples present on the guide member (1) to align. The staple driver (14) and the spring raising the cup (3) are formed by a single hardened steel piece, said piece being shaped in such a way as to present a central rectilinear strip length effective to define, in side view, with the adjoining strip lengths, an obtuse angle and a right angle respectively.

Said single piece of hardened steel is suitably positioned and fixed in a suitable housing, formed in the cup (3), by means of two containing guide members (21) and (22), and a hollow (25), thereinto insert two tabs (23) and (24) formed by die-cutting said single steel piece.

This fixing device prevents rivetings or antiesthetical fixing devices for said hardened steel piece forming the staple driver (14) and raising spring (19) from appearing to the view, onto the upper surface of the cup (3).

The cup (3) may be made of a thermopressed plastics material or die-cast aluminium.

Said cup (3) has to be of light weight in order to provide a correct operation of said pin (15) and counter-guide member (2), having an inverted-U-shaped cross section, since these two members have to be maintained in a raised condition to allow for said staples to freely slide onto the guide member (1), in the rest condition of the stapler device.

The anvil (20) is formed by a hardened steel piece, suitably shaped, in such a way as to present hollows or cavities where the staple is closed, said staple being closed either with one or two opened legs for the pin or needle stapling.

The three operating positions may be obtained by shifting the anvil (20) laterally with respect to the central position thereof; said anvil (20) is held in position due to the counter-biassing of the spring (26), housed in the base (6) of the stapler device and the pin (27) rigid with said small anvil (20).

Each position is stabilized by the counter-biassing between a transversal strip spring (26), housed in the base (6) and provided with a central recessed bend, and a longitudinal pin (27) rigid with a 90° bent lug (20'), of the anvil (20) and sliding along the strip spring (26).

Each front portion of the counter guide member (2) is provided with a 90° cut or notch, in which is freely housed one of the side axes (15) supporting a roller (15').

This latter is provided with a hollow seat (15'), about which is passed a spiral spring (16) fixed, at one end thereof, to a projecting tab formed, under the horizontal surface of said counter guide member (2), at the rear end thereof, and, at the other end thereof, to a staple pushing member (31) located onto the guide member (1), in an analogous way to the staples.

Owing to the action of the spiral spring (16), the axes (15) tend to adhere to the 90° hollow or recess (18) of the counter guide member (2).

The spiral spring (16), in a first length (16') thereof, slides under the horizontal face of the counter guide member (2), turns about the hollow (15'') of the roller (15'), and provides a traction action onto the staple pushing member towards the front end (1') of the guide member.

In this manner, the aforesaid staple pushing member presses onto the metal staples thereby pushing said staples towards the descent space (13').

As the cap (3), provided with a counter guide member (2) fixed in the inside thereof, is pressed to operate the stapler device, the spring (19) presses onto said counter guide member (2) and, exceeding the resistance of the spring (16), allows for the axis (15) to slide along the slanted length of the notch or cut (17), sliding along the U-shaped recess.

As the cap (3) is rised, in the rest position of the stapler device, the arrangement or location of the hollow or recess is such that the counter guide member (2) is slightly raised from the guide member (1) and hence from the metal staple sliding surface, thereby facilitating the sliding of said staples onto said guide member.

As the cap (3) is pressed to operate the stapler device, the cap (3) and intermediate body (7) are firstly downwardly shifted, thereby exceeding the weak resistance or counter biassing of the resilient counter biassing member.

In this manner the body (7) is brought to clamp against the base (6) of the stapler the sheets to be stapled, previously inserted thereinto.

With a continued pressing onto the cap (3), the counter guide member (2) rests above the staples and then, due to the progressive deformation of the spring (19), the staple driver (14) lowers as far as to meet the staple present onto the guide member (1), at the space (13), since it is pressed by the staple pushing member, thereby downwardly pushing said staple to carry out the stapling operation onto said sheet.

The staple driver (14) is able to lower as far as to slightly pass the lower face of the body (7).

The movement, from the top to the bottom and vice-versa, of said staple driver (14) is delimitated by the upper end and respectively lower end of the small window, provided through said blade, thereinto is inserted the projection (2') of the counter guide member (2).

Moreover the spring (19) acts as a raising spring for the staple driver (14), since it restores said blade to the original position thereof after each stapling operation.

In the cap (3) as it was thereinabove described, is housed a counter-guide member (2), effective to partially rotate and having an U-shaped cross-section. This counter-guide member (2) is provided, at the rear portion thereof, with two opened eyelets (2'), encompassing the horizontal pin (4) and it is furthermore provided, in the front portion thereof, with a projection (2').

Onto the inner surface of the cap (3) is fixed, in the intermediate portion, a metal rised blade (19), acting onto the spring and, in the front portion thereof, a staple driver (14). Said staple driver (14) is provided with a slot thereinto is resiliently inserted the projection (2') of the counter-guide member (2), this latter being held by the spring (19) in a downwardly pushing position.

From the preceding description and the examination of the accompanying drawings are self evident the remarkable technical and constructional advantages, the functionality and practicity of use characterizing the improved office stapler device according to the present invention.

In the carrying out of the instant stapler device variations and modifications may be brought about, without departing from the scope of the present invention.

I claim:

1. In a stapler apparatus having a base, an intermediate elongated body having a U-shaped transverse cross section connected to said base for pivotal movement relative thereto, an elongated guide member supported within said intermediate body and having a transverse cross section disposed to receive staples for use with the stapler apparatus, an elongated counter-guide member carried on said intermediate body and cooperating with said guide member to guide said staples therealong, means on said intermediate body adjacent one end of said guide member and defining with said guide member a passage for the exit of said staples one at a time, an elongated cap member supported by said base for pivotal movement relative thereto and for pivotal movement relative to said intermediate body, and a driver blade carried by said cap member and disposed for insertion into said passage to forcibly eject said staples therethrough, one at a time, the improvement which comprises means connecting said guide member to said intermediate body for limited oscillatory movement relative thereto between a normal operating position of said guide member and a staple-jam-clearing position thereof in which said passage is enlarged to accommodate expulsion therefrom by the action of said driver blade of a staple jammed in the passage, said guide member having a projection accommodating manually imparting said oscillatory movement to the guide member; said counter-guide member being releaseably connected to said cap member by a projection extending through a slot in said driver blade to allow pivoting said cap member away from said counter-guide member to facilitate access thereto; V-shaped notches in said intermediate body disposed for receiving engagement with a resiliently biased pin carried by said counter-guide member to releaseably connect said counter-guide member to said intermediate body and allow pivoting said counter-guide member away from the intermediate body to provide access to staples on said guide member, said V-shaped notches being disposed to hold said pin to position the counter-guide member at a predetermined clearance distance from staples on the guide member.

* * * * *